US011506038B2

(12) United States Patent
Harrel et al.

(10) Patent No.: US 11,506,038 B2
(45) Date of Patent: Nov. 22, 2022

(54) MODULAR FRACING WELLHEAD EXTENSION

(71) Applicant: BLUECORE COMPLETIONS, LLC, Midland, TX (US)

(72) Inventors: Travis Harrel, Midland, TX (US); Austin Bainbridge, Corpus Christi, TX (US)

(73) Assignee: BLUECORE COMPLETIONS, LLC, Midland, TX (US)

( * ) Notice: Subject to any disclaimer, the term of this patent is extended or adjusted under 35 U.S.C. 154(b) by 0 days.

(21) Appl. No.: 17/476,155

(22) Filed: Sep. 15, 2021

(65) Prior Publication Data

US 2022/0082005 A1 Mar. 17, 2022

Related U.S. Application Data

(60) Provisional application No. 63/079,269, filed on Sep. 16, 2020.

(51) Int. Cl.
*E21B 43/26* (2006.01)

(52) U.S. Cl.
CPC ..... *E21B 43/2607* (2020.05); *E21B 43/26* (2013.01)

(58) Field of Classification Search
CPC ..... E21B 43/2607; E21B 43/26; E21B 33/03
See application file for complete search history.

(56) References Cited

U.S. PATENT DOCUMENTS

| | | | | |
|---|---|---|---|---|
| 7,841,394 | B2 | 11/2010 | McNeel et al. | |
| 8,590,556 | B2 | 11/2013 | Kendrick | |
| 9,932,800 | B2 | 4/2018 | Guidry | |
| 2010/0300672 | A1 | 12/2010 | Childress et al. | |
| 2011/0259584 | A1* | 10/2011 | Broussard, II | E21B 43/26 166/177.5 |
| 2017/0145790 | A1* | 5/2017 | Guidry | E21B 34/02 |
| 2017/0370172 | A1 | 12/2017 | Tran et al. | |
| 2018/0347286 | A1* | 12/2018 | Scott | E21B 17/021 |
| 2019/0302810 | A1* | 10/2019 | Kibler | B25J 15/0019 |
| 2020/0325752 | A1* | 10/2020 | Clark | E21B 43/26 |
| 2021/0010358 | A1* | 1/2021 | Guidry | E21B 43/26 |

* cited by examiner

*Primary Examiner* — James G Sayre

(57) ABSTRACT

A modular fracing wellhead extension for use in a fracing system for enabling the connection of wells on a well pad that are out of reach of an articulated connection platform. The extension modules use the same connection interface as deployed on the wellheads in reach of the articulated connection platform so that an uninterrupted fracing operation can be carried out on two or more wells even if some of the wells are not within the usual reach of the articulated connection platform.

11 Claims, 12 Drawing Sheets

Cameron Manifold

Jumper Manifold

Zipper Manifold

Service truck with Modular Fracing Wellhead Extensions

Service truck out of range

MODULAR FRACING WELLHEAD EXTENSION

CROSS-REFERENCE TO RELATED APPLICATIONS

This application claims benefit of U.S. Provisional Application No. 63/079,269, filed Sep. 16, 2020, entitled MODULAR FRACING WELLHEAD EXTENSION, which is incorporated by reference herein in its entirety. This application is related to U.S. patent application Ser. No. 16/696,487, entitled HIGH PRESSURE JUMPER MANIFOLD, and to U.S. patent application Ser. No. 16/696,563, entitled HIGH PRESSURE AND HIGH FREQUENCY CONNECTOR AND ACTUATOR SYSTEM THEREFORE, each of which is incorporated by reference herein in its entirety.

FIELD OF INVENTION

The present invention relates in general to fluid stimulation equipment for oil and gas wells and in particular to a fluid direction manifold subjected to severe operating conditions, such as the high pressures, high flow rates, and abrasive fluids commonly found in hydraulic fracturing operations and other oil and gas stimulation applications.

BACKGROUND OF INVENTION

In one of the most severe service applications known today, hydraulic fracturing ("fracing"), very high pressure slurry is pumped at very high rates. In particular, fracing slurry is forced down a wellbore with enough pressure to fracture the hydrocarbon bearing rock formations and force particulates into the resulting cracks. When the pressure is released, the particles ("proppant"), which may be sand or other high compressive strength additives such as ceramic particles and bauxite, remain in the factures (cracks) and keep the fractures open. This "mechanism" then allows pathways for hydrocarbon to flow from the rock that was previously solid.

As the fracing industry becomes more efficient, multiple fracing stages are being pumped from a single "fracing factory", consisting of many fracing pump trucks and accessory equipment to multiple wells, as first disclosed in U.S. Pat. No. 7,841,394, assigned to Halliburton. In order to make this process efficient, the concept of a distribution manifold was introduced as disclosed in U.S. Patent Application Publication No. 2010/0300672, assigned to FMC, which describes in detail the method of using such a manifold. This technique has become common practice, with this type of manifold commonly known as a zipper manifold in the hydraulic fracing industry.

When zipper manifolds started being used for fracing fluid distribution around 2009-2010, most wells were vertical and the number of stages being pumped per well was around 10 to 20. A stage is the process of pumping a mixture of proppant (typically sand), water and some chemicals down a wellbore under high pressure, usually in excess of 9000 psi, for fracturing a specific interval of the wellbore. Since then, the industry has been getting more and more aggressive and most wells being fraced today are doing so in long horizontal wellbore sections having 50 to 100 stages.

A modern fracing operation typically runs 24 hours per day for several days. In the Permian basin of Texas, 70 fracing stages per well are now common. Each stage can last 1 to 2 hours and results in a small portion of the total wellbore being fractured. Then the pumps are stopped, and wireline is run. These wireline operations do a variety of things depending on the completion system being used. For example, a wireline can used be to set a plug, perforate a new zone, or open or close a sliding sleeve. This prepares a new section (interval) of the wellbore for fracing.

Then a new stage is pumped, fracturing the newly exposed wellbore. This process continues until all the sections of the wellbore have been fraced. It is common to achieve 8 to 15 fracing stages in a day, rotating the activity continuously between typically 3 wells. With 70 stages per well, this means that the zipper manifold is operating continuously for 14 to 28 days (excluding rig-up and rig-down time).

The frac flow is routed from the main incoming factory line (missile) to the distribution (zipper) manifold that is tied in to multiple wells. This allows simultaneous operations, and for a 3 well pad with a 3-way zipper manifold it means that one well is having a frac stage being pumped, one is idle and one is having wireline operations. The number of fracing stages is increasing with up to 100 stages and more per well possible in the foreseeable future.

This means that the valves on the zipper manifold are being opened and closed over 100 times on a three well pad job resulting in many problems. One problem is the wear of valves and subsequent downtime as the conditions for valves are typically very harsh at the zipper manifold location. The particle size distribution in these fracing fluids is distributed so that the larger particles can prop open larger cracks and finer particles can prop open the very tips of the cracks, which are microscopic in nature. The particle sizes can vary from 0.004 inches to 0.01 inches (No. 140 Mesh to No. 8 Mesh). The pumping pressure can be up to 15,000 psi and the slurry velocity through a valve bore of 5.125 inches, as is typical of a 5⅛ inch, 15000 psi valve, is well above erosional velocity of about 50 to 70 feet per second. Moreover, the fracing is typically preceded and followed by an acid wash of 15% hydrochloric acid, which accelerates corrosion.

As one skilled in the art of mechanical engineering can ascertain, the fracing "mechanism" will inject proppant particles into any crack, orifice or possible leak path in the valve assembly. The injected particles remain in the valve assembly when the pressure is released. Small particles as large as 0.004 inches are within machining tolerances of steel parts and therefore will find their way into metal sealing surfaces. With the high velocity of abrasive fracing fluid, any weakness or point of turbulence can very quickly lead to a washout of a seal area or any interface. With ever increasing numbers of stages, the valve life limit can be reached during an operation resulting in repair/maintenance downtime. This is a safety problem as the repair person is exposed to an increased safety risk as all the equipment is interconnected.

With the zipper manifold always having one high pressure fracing operation concurrent with a residual pressure wireline operation, and possibly other preparation work on the idle well, there is a lot of room for errors. Even with procedures and strict protocols, accidents are common. A typical example occurs when there has been repair/maintenance work on a frac pump, after which the pump is started for testing. If this series of events was not properly regulated, high pressure can be applied accidentally via the zipper manifold to an undesired location.

The pressure pumping industry has become more automated with the use of hydraulic valves, which allow for automated operations from a safe remote location. As a result of this automation, human error has become more prevalent as it is very easy to simply "flip a switch" to open and close pressure barriers (i.e., valves). These pressure barriers are crucial for safety, since wells and pump trucks are potentially fatal pressure sources and the operation of an incorrect pressure barrier may result in a fatal incident.

In a typical operation occurring for a three well pad scenario, Well #1 is idle and the zipper valves are closed, which isolates pump pressure to the wellbore. Well #2 is pumping and the zipper valves are open, such that pressure from the pumps is applied to the wellbore. Well #3 is undergoing wireline operations and the zipper valves are closed, isolating the pump pressure from the wellbore and the wellbore pressure back to the pumps.

Once Well #2 finishes pumping and the zipper manifold valves are shut, Well #2 becomes idle. However, Well #2 is still under pressure from the last frac stage, such that if the zipper manifold operator is instructed to open Well #1 to begin pumping, but instead accidently opens Well #2, the pumps are exposed to wellbore pressure. In this scenario, it is highly probable that the high pressure piping connected to the pumps is disconnected, as the pumps also require frequent maintenance during operations. The workers repairing the pumps are then subject to injury.

When using a zipper manifold, the in-line flowline valves ("ground valves") between the zipper manifold and the pumps are typically left open because the zipper manifold valves are used to provide the primary pressure barrier, with two valves being used in series for double isolation. These valves are operated as isolation or flow pairs, being opened and closed one after another. The valves closest to the pumps on the manifold are exposed to every frac stage of all the wells being fraced. So, on a three well pad, these valves are subjected to up to 200 to 300 stages of frac slurry. Because of this, the zipper manifold valves are the most likely to malfunction, which causes the non-productive time and safety hazards.

There is a need to further reduce the activity of personnel in the dangerous area between the pump trucks and the wells. The introduction of zipper manifolds with hydraulic valve actuators has not fully solved this issue, as personnel are required more and more frequently to repair valves on the zipper manifold with ever increasing numbers of fracing stages. With these stages creating more demand on the pumps, these valves are also being repaired with ever increasing frequency on jobs. Both types of repairs require opening of components that are directly connected to pressure sources, either the well or the pumps. The easy actuation of valves via hydraulics has increased the number of safety incidents and this will continue to increase as maintenance activity increases with more stages.

The fracing industry in its desire to ever increase efficiency is now looking at 6 to 10 well pads, as horizontal placement of wellbores allows for design efficiency. This will mean one fracing factory of multiple pumps being interfaced with 6 or more wells using two or more three-way zipper manifolds or other efficient configurations with many more valves leading to further safety issues.

There is a more reliable manifold solution that: eliminates down time due to valve repair; provides a safer method of operation; and can be easily expanded to more well pads. Such a manifold solution termed "jumper manifold" is presented in U.S. patent application Ser. No. 16/696,487, which is incorporated by reference herein in its entirety. Advantageously such a jumper manifold requires a very reliable high-pressure connector that needs to be connected and disconnected many times during these types of continuous fracing operations without requiring maintenance.

U.S. Pat. No. 9,932,800 assigned to Cameron discloses the concept of using a monobore manifold that runs along all of the wells in a wellpad, essentially a continuous Zipper Manifold. This is time consuming to rig up with the large bore lines requiring very careful adjustment to be able to line up several wells simultaneously.

Another way of working without a zipper manifold is to use a movable flowline, as disclosed in U.S. Pat. No. 8,590,556 assigned to Halliburton. Here the valves on the truck are used as isolation valves and the fracing line is disconnected and swung over to the next well to be fraced. The well that is being wirelined and the well that is idle are both isolated as they are disconnected completely from the main fracing line that is connected to the pumps. This method eliminates the possibility of exposing the pumps to wellbore pressure of the wells not being fraced. However, this method requires workers to be in the "red zone" (i.e., the "widow maker area") a distance of 75-100' from an area around the flowline between the wellhead and pumps. The Halliburton design requires an operator to control the movable flowline from the truck within this "red zone".

This Halliburton articulated line concept has limitations in the ever more efficient eco-system of fracing rig-ups. On older design 2 or 3 well pads it was possible to place the truck (vehicle) efficiently between the fracing pumps and the wellheads so that each wellhead could be serviced in turn without moving the vehicle or platform as described in the claims of '556. With the drive for efficiency resulting in wellpads with 6 or more wellheads it is not possible to reach all 6 well heads from one position. That means the vehicle or platform has to be moved during the operations which is absolutely not efficient as this requires breaking some connections from the main pump line, adding extensions to enable the vehicle to move further along, requiring renewed pressure testing. Adding another vehicle with such an articulated line is possible, also requiring an additional manifold to split the main incoming pump line. This is cost prohibitive.

What is needed is an efficient and cost-effective solution that enables the advantages of the articulated line concept without adding significant cost or complexity. This is the scope of the present invention which proposes a system that enables safe extension for the furthest wellheads thus enabling the vehicle or platform with an articulated line to stay in one place.

SUMMARY OF INVENTION

To remove the need to have additional articulated platforms or to move the vehicle with an articulated system during operations, a "Modular Fracing Wellhead Extension" (MFWE) is introduced. These MFWEs are used to create connection points within the range of the articulated line from the vehicle or platform so that the integrity of main line from the pumps to the vehicle/platform is preserved throughout the whole operation and that the articulated line can reach four or more connection points leading to all of the wellheads at the wellpad being fraced.

These MFWEs can be rigged up at the same time as the connections for the wellheads within reach of the articulated line are prepared, which is done before the fracing operations commence so as not to interfere in the fracing process once the operations have started.

The MFWE modules use the same connection interface as deployed on the wellheads in reach of the articulated connection platform.

In one aspect, a modular wellhead extension manifold is disclosed for providing a fluid connection from a wellhead line supplying a source of fluid for delivery to a wellhead that is disposed beyond the reach of the wellhead line, to a wellhead extension line connected to the wellhead. The modular wellhead extension manifold comprises an outlet block having a top-facing fluid inlet and a side-facing fluid outlet operably connectable to a wellhead extension line that is connected to a wellhead for delivering a fluid to the wellhead. A first hydraulically actuated isolation valve having a bottom-facing fluid outlet is operably connected to the fluid inlet of the outlet block, a top-facing fluid inlet, and a first valve mechanism is connected between the fluid outlet and fluid inlet of the first isolation valve. A second hydraulically actuated isolation valve having a bottom-facing fluid outlet is operably connected to the fluid inlet of the first isolation valve, a top-facing fluid inlet, and a second valve mechanism is connected between the fluid outlet and fluid inlet of the second isolation valve. Each respective valve mechanism of the respective isolation valve is selectively hydraulically movable between an open position allowing fluid flow through the respective isolation valve and a closed position blocking fluid flow through the respective isolation valve. A connector assembly having a lower portion including a bottom-facing fluid outlet is operably connected to the fluid inlet of the second isolation valve and an upper portion including a fluid inlet is connectable to a wellhead line for receiving the fluid from the wellhead line. The upper and lower portions of the connector assembly can be selectively engaged to, and disengaged from, one another without the use of bolted fasteners. When engaged to one another, the upper and lower portions of the connector assembly form a fluid-tight path from the fluid inlet of the connector to the fluid outlet of the connector and the upper and lower portions cannot be moved apart from one another. When disengaged from one another, the upper and lower portions of the connector assembly can be repositioned apart from one another. When the upper and lower portions of the connector assembly are engaged to one another and the respective valve mechanisms of the first and second isolation valves are in the open positions, the fluid from the wellhead line can flow through the modular wellhead extension manifold into the wellhead extension line for delivery to the wellhead.

In one embodiment, selective operation of the respective hydraulically actuated isolation valves is remotely controllable from a predetermined distance away from the modular wellhead extension manifold.

In another embodiment, the upper portion of the connector assembly has a side-facing fluid inlet that can rotate relative to the lower portion of the connector assembly to change the angle of the side-facing fluid inlet of the connector relative to the side-facing fluid outlet of the outlet block.

In yet another embodiment, the lower portion of the connector assembly further comprises a spool, wherein the spool comprises a flanged bottom end for bolted connection to the fluid inlet of the second isolation valve. The lower portion further comprises a top configured with a profile for the upper portion of the connection assembly to latch on.

In still another embodiment, a height of the fluid inlet of the connector above the outlet block can be selected by changing a length between the flanged bottom end of the spool and the profile of the spool.

In a further embodiment, the connector assembly further comprises a plurality of dogs arrayed annularly around a junction between the upper and lower portions of the connector assembly, each dog having a plurality of inward-facing teeth. The lower portion of the connector assembly includes a grooved upper end adjacent the junction and a flanged bottom end for bolted connection to the fluid inlet of the second isolation valve. The upper portion of the connector assembly includes a grooved lower end adjacent the junction and an interface for the fluid inlet. The connector assembly further comprises at least one ring encircling the upper and lower portions and operably connected to the plurality of dogs. Rotation of the ring in a first direction relative to upper and lower portions causes the plurality of dogs to move inwards until the teeth engage the grooves on the upper and lower portions to engage the upper and lower portions, and rotation of the ring in a second direction relative to the upper and lower portions causes the plurality of dogs to move outward until the teeth disengage the grooves on the upper and lower portions to disengage the upper and lower portions.

In as still further embodiment, one of the upper and lower portions defines an axial socket, and the other of the upper and lower portions defines a projection configured to interfit with the axial socket to maintain axial alignment of the upper and lower portions when engaged.

In a yet further embodiment, the modular wellhead extension manifold further comprises a skid having a skid frame operably connected to the outlet block. The skid supports the modular wellhead extension manifold on a ground surface.

In another embodiment, the skid frame further comprises a skid base plate disposed below the skid frame, and a plurality of jacks attached between the skid frame and the skid base plate to allow changing the height of the outlet block or connector assembly relative to the ground surface by selectively changing the lengths of the plurality of jacks.

In yet another embodiment, the skid frame further comprises a skid base plate disposed below the skid frame, and a plurality of jacks attached between the skid frame and the skid base plate to allow changing the angle of the outlet block relative to the ground surface by selectively changing the lengths of the plurality of jacks.

In another aspect, a system is disclosed for supplying fracing or stimulation fluid to a plurality of wellheads that enables extension of a connection point for the plurality of wellheads to be extended from an original specified radius of operation to a new specified new radius of operation, the new radius being greater than the original radius. The system comprises a respective extension line connected to each of the respective wellheads disposed outside of the original radius of operation and extending into the original radius of operations. The system further comprises a respective device attached to each respective extension line within the original radius of operations that is configured to enable the same connection interface as the wellheads inside the original radius of operation.

In one embodiment, each respective device has the same connection interface as the wellheads within the original operating radius.

In another embodiment, each interface includes a remotely operated connector that can selectively connect to a fluid supply line.

In still another embodiment, the remotely operated connector is actuated by hydraulics.

In yet another embodiment, the original radius of operation is determined by a dimension of a crane affixed on a stationary platform or vehicle.

In a further embodiment, the original radius of operation is determined by a fluid supply line attached to a swivel point.

In a still further embodiment, the connector is a remotely operated connector.

In a yet further embodiment, the remotely operated connector is actuated by hydraulics.

In another embodiment, the flow path of the fracturing or stimulation fluid extends through a port in the connector, then extends down to a bottom of the device and then extends to out of the device to the wellhead being fraced.

In yet another embodiment, the device is adjustable in a vertical axis, horizontal axis and angular axis, thereby enabling easier connection.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

The principles of the present invention and their advantages are best understood by referring to the illustrated embodiment depicted in FIGS. 1-14 of the drawings, in which like numbers designate like parts.

Figure 1:
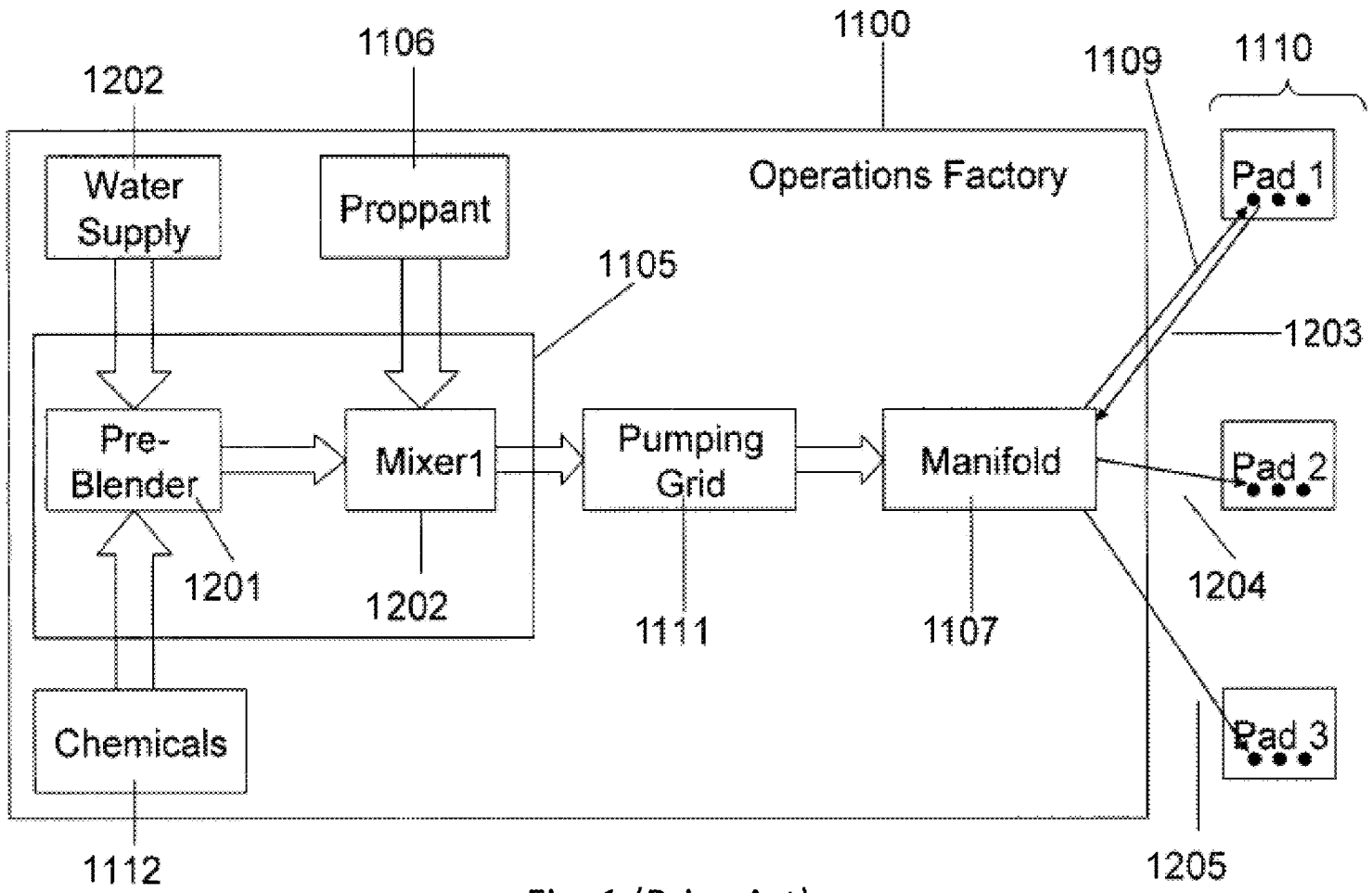
Fig. 1 (Prior Art)
FIG. 1 is a prior art block diagram of a typical conventional fracing operation installation.

FIG. 1 is a block diagram of a prior art hydraulic fracturing installation, as disclosed in U.S. Pat. No. 7,841,394 assigned to Halliburton. FIG. 1 shows the typical installation used for most fracing operations, which includes an operations factory 1100 consisting of a blending unit 1105 connected to a chemical storage system 1112. The blending unit 1105 includes a pre-blending unit 1106 wherein water is fed from a water supply 1108 and blended with various chemical additives and modifiers provided by the chemical storage system 1112.

This mixture is fed into the blending unit's hydration device and the now near fully hydrated fluid stream is blended in the mixer 1107 with proppant (typically sand) from the proppant storage system 1109 to create the final fracturing fluid. This process can be accomplished continuously at downhole pump rates. The final fluid is directed to a pumping grid 1111, which commonly consists of several pumping units that pressurize the frac fluid, which is subsequently directed to a central manifold 1107. The central manifold 1107 connects and directs the fluid via connections 1109 to multiple wells 1110 simultaneously or sequentially. The manifold 1107 is typically known in the industry as a zipper manifold. One advantage of the principles of the present invention is the replacement of this manifold.

Figure 2:
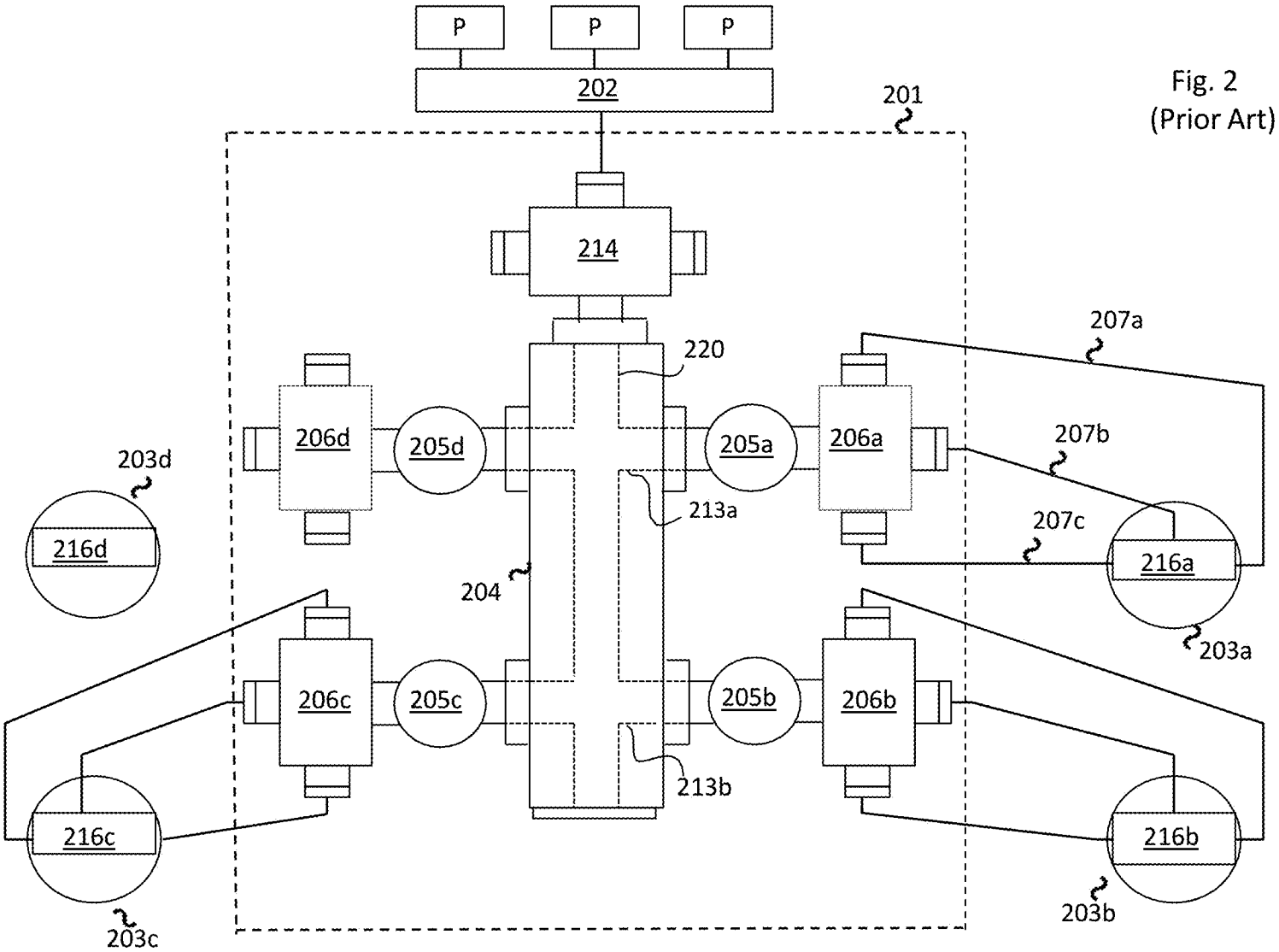
Fig. 2 (Prior Art)
FIG. 2 is diagram of a typical prior art conventional zipper manifold system.

FIG. 2 is a prior art design of a typical zipper manifold system having the common features used by almost all fracing companies today. In particular, FIG. 2 shows a zipper manifold 201 connected between a high-pressure frac vessel 202 and a number of representative wellheads 203*a*-203*c*. The high pressure frac vessel 202 is fed by a number of high-pressure pumping units P. In certain applications, however, the high pressure frac vessel 202 may be eliminated and the pumping units P connected directly to the zipper manifold 201. The zipper manifold 201 includes a block member 204, which is ideally a solid piece of metal through which a flow bore is machined. The flow bore includes an inlet branch 220 and a number of outlet branches 213 (e.g., 213*a-b*). At least one inlet cross 214 is connected to the block 204 by suitable means, such as bolts (not shown).

In use, the high pressure frac vessel 202 is connected to the inlet cross 214 and each outlet cross 206 (e.g., 206*a-d*) is connected to a corresponding frac tree 216 (e.g., 216*a-d*), which has been installed on a respective wellhead 203. In particular, a number of high-pressure lines 207*a*-207*b* connect the high pressure frac vessel 202 to corresponding inlet connection adapters on the inlet cross 214. Also, each outlet connection adapter on a particular outlet cross 206 is connected to a high-pressure line 207 which in turn is connected to a corresponding inlet connection on the frac tree 216. Thus, while the inlet cross 214 is connected to multiple pumps lines, each frac tree 216 is connected to a single outlet cross 206. However, since each outlet cross 206 comprises multiple outlet passages, a single frac tree 216 may be connected to several high-pressure lines 207. Moreover, since flow from the flow bore 220 into each outlet cross 206 is controlled by a corresponding valve 205 (e.g., 205*a-d*), each of these high-pressure lines 207 can be controlled with a single valve, or as in the case with a modern zipper manifold, dual valves with hydraulic actuators that are remotely controlled.

The block member 204 and the valves 205 are preferably supported on a single skid and connected to the skid by suitable means, such as mounting brackets (not shown). This arrangement allows the zipper manifold 201 to be transported and positioned on site as a unified assembly. Different versions of this type of arrangement, which provide more outlets such as four or six are in common use.

As discussed above, one problem faced with these prior art manifolds, particularly in view of the ever-increasing number of frac stages, is the reliability of the valves. The need for valve repairs leads to downtime, as well as increased risk to personnel who have to work in the danger zone. Furthermore, remote operation can lead to operational disconnects in communication and incorrect routing of high-pressure slurry, which is a main cause of accidents on fracing operations. A system is therefore required that eliminates the use of valves and replaces them with an advantageous arrangement, which will be referred to as a jumper manifold to distinguish it from a conventional zipper manifold.

Figures 3A, 3B, 3C:
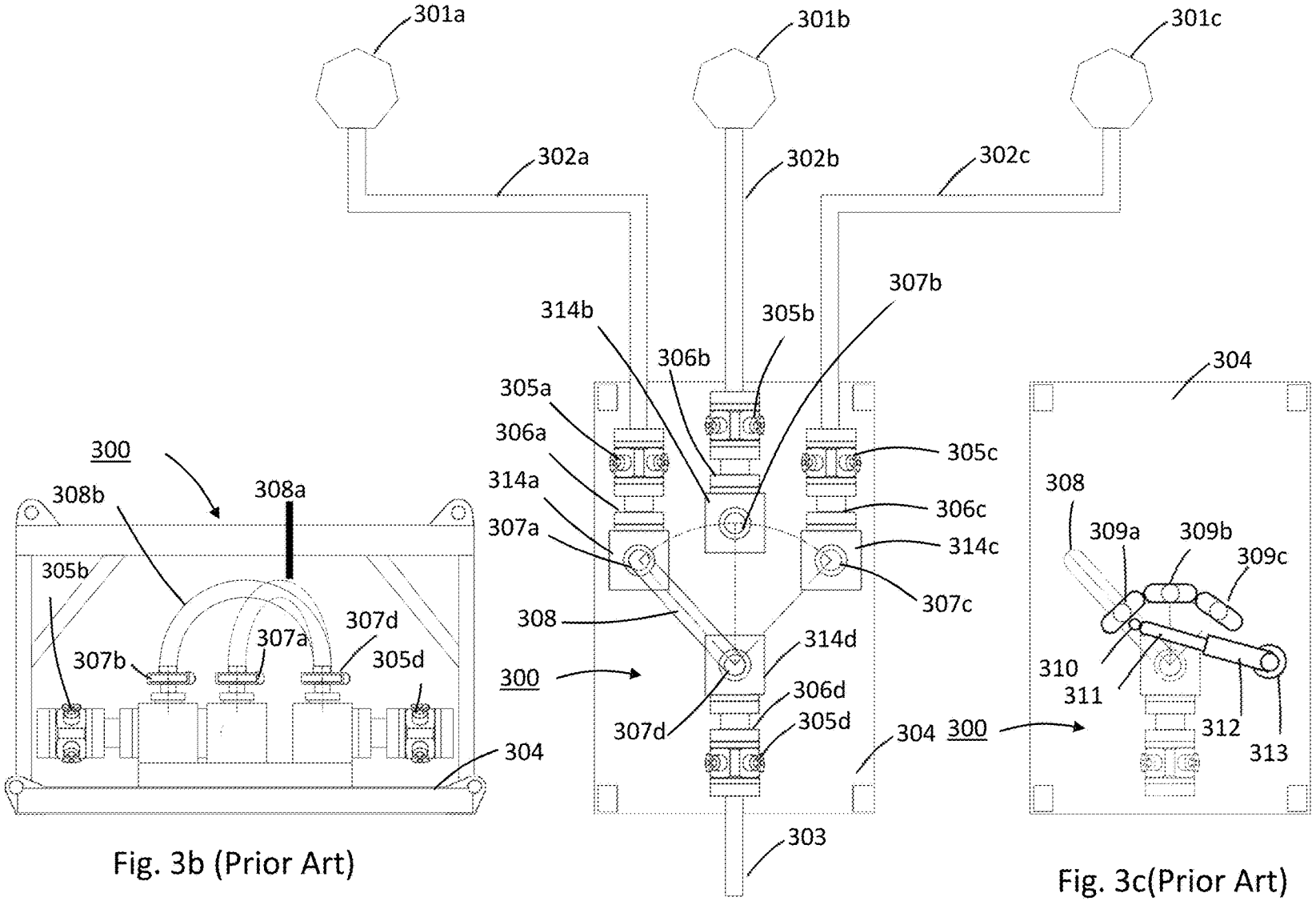
Fig. 3a (Prior Art)
Fig. 3b (Prior Art)
Fig. 3c(Prior Art)
FIG. 3*a* is a schematic plan view of an exemplary prior art embodiment of an installed jumper manifold system.
FIG. 3*b* is a side view of the jumper manifold system of FIG. 3*a;*
FIG. 3*c* depicts a detail of manipulation of the jumper system of FIG. 3*a;*

FIG. 3A is a schematic plan view of one embodiment of the principles of the present invention showing a jumper manifold 300 installed. FIG. 3B is a side view of the jumper manifold 300 and FIG. 3*c* shows a detail of the manipulation of the jumper 308.

The function of the jumper manifold 300 is generally the same as in the prior art discussed in connection with FIG. 2. However, jumper manifold 300 has no valves and is suitable for use with single large bore lines, instead of many small lines, a concept known as monobore in the industry.

In the embodiment of FIGS. 3*a-c*, three wells 301*a*, 301*b* and 301*c* are shown being supplied by three monobore lines 302*a*, 302*b* and 302*c*, respectively. Monobore lines 302*a*, 302*b*, and 302*c* are connected to distribution spools 305*a* to 305*c*, which are preferably that the same type as spool 206 in FIG. 2. Advantageously, jumper manifold 300 may be rigged up in the conventional way, with several outgoing lines for the spools 305*a* to 305*c*. In the example shown in FIG. 3*a*, the unused bore outlets on the spools 305 are plugged with a blind flange (not shown).

Similarly, the inlet line 303 is shown as a monobore, which can be replaced by multiple lines coming into spool 305*d*. Spools 305 can have 3 to 6 inlets or outlets each and are connected to blocks 314*a* to 314*d*. In alternate embodiments, spools 305*a* to 305*d* may be connected though a single block containing parts 305, 306 and 314. The blocks 314*a* to 314*d* have mechanical connectors 307*a* to 307*d* connected on top that can be remotely actuated to open and close and effect a connection. Preferably, the entire jumper manifold 300 assembly is mounted on a single skid 304.

Assuming, for discussion purposes, that it is desired to frac well 301*a*. Then a jumper 308, which is a pipe or other conduit with two end connectors, is installed between blocks 314*a* and 314*d*. Specifically, the jumper 308 is mechanically latched with connectors 307*a* and 307*d* respectively to affect a pressure tight connection.

Connectors 307*b* and 307*c* preferably have solid plugs installed (not detailed) so that the lines 302*b* and 302*c* are isolated from possible pressure sources 301*b* and 301*c* respectively. As a result, there is a direct connection from inlet line 303 to well 301*a*, such that well 301*a* is completely isolated from wells 301*b* and 301*c*, with no valves in the configuration that can leak, fail or be inadvertently operated. The mechanical connectors (latches) 307*a* to 307*d* preferably include pressure interlocks preventing their unlatching under pressure.

If it is desired to fracture the next stage for well 301*b*, then line 302*b* will be isolated by two valves on the frac stack (not shown) on well 301*b*, and depressurized by a bleed line (not shown). Then the connector 307*b* can be opened and the plug (not shown) removed. Thereafter line 302*a* from well 301*a* can be similarly isolated and depressurized as previously done for line 302*b*.

The upstream inlet line 303 from the frac pumps can be isolated by the dual isolation valves present in the main frac line (not shown, off skid) and bled off. Now the jumper 308 can be unlatched between connectors 307*a* and 307*d*, lifted and pivoted to enable latching with connector 307*b*, where previously the plug has been removed. The jumper 308 is lowered and then latched with connectors 307*b* and 307*d*. A blind plug is installed in latch 307*a*. Now well 301*b* can be worked with fracturing pressure, leaving well 301*a* and well 301*c* completely isolated for other activities like wirelining.

In FIG. 3*b*, the prior position 308*a* of jumper 308 is shown in broken lines and the new position 308*b* after changeover is indicated in solid lines. In FIG. 3*c*, a simple method of mechanical manipulation is shown with jumper 308 capable of being lifted and lowered by pistons 309*a*, 309*b* and 309*c*. A pivot point 310 is attached to a piston 311 and engaged in a cylinder 312 that is mounted on a stand 313 attached to skid 304. Stand 313 can move up and down as the jumper is raised and lowered and, by means of actuation, such as air or hydraulic fluid, can pivot the jumper into the desired position. There is any number of ways of achieving the desired manipulation of one end of the jumper 308 between connectors 307*a* to 307*c*, while the other end stays in alignment with connector 307*d*.

As the connection between the jumper and the plugs to the blocks is a vertical one, alignment can be carefully controlled and multiple seals or metal seals may be used, as there are no tolerance requirements, such as those required for moving a valve member. Consequently, the sealing system will be much more reliable than a valve and removes failure points.

Figure 4:
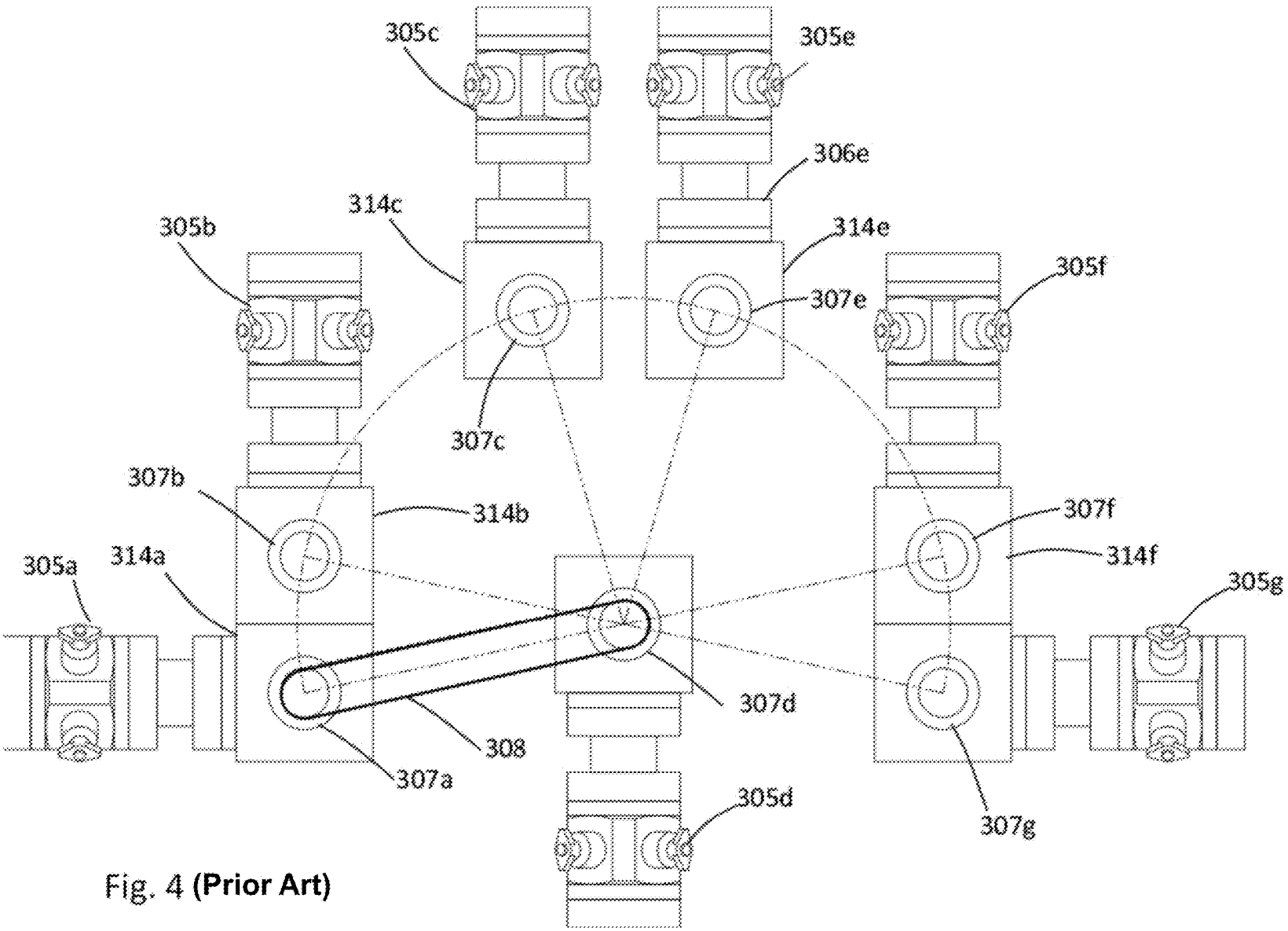
Fig. 4 (Prior Art)
FIG. 4 is an alternate jumper manifold adapted to connect with up to six wells.

In FIG. 4, another alternative arrangement is shown, which is designed to connect with up to six wells. An advantageous aspect of this alternative is the circular nature of the arrangement, which enables numerous outlet legs to be assembled on a single manifold. In particular, outlet spools 305*a*, 305*b*, 305*c*, 305*e*, and 305*f* can be individually supplied by one inlet spool 305*d* connected to connector 307*d*. (Preferably, for all embodiments of the present principles, there is only one jumper, though a spare maybe carried.) It is very difficult or impossible to misconnect the jumper 308. Jumper 308 is shown installed between connector 307*d* on the inlet and connector 307*a* on the outlet. It can be moved by manipulation (not shown) to any of the outlet connectors 307*b*, 307*c*, 307*e*, 307*f* and 307*g*. Monobore lines may be used or multiple lines connected to spools 305.

Figure 5:
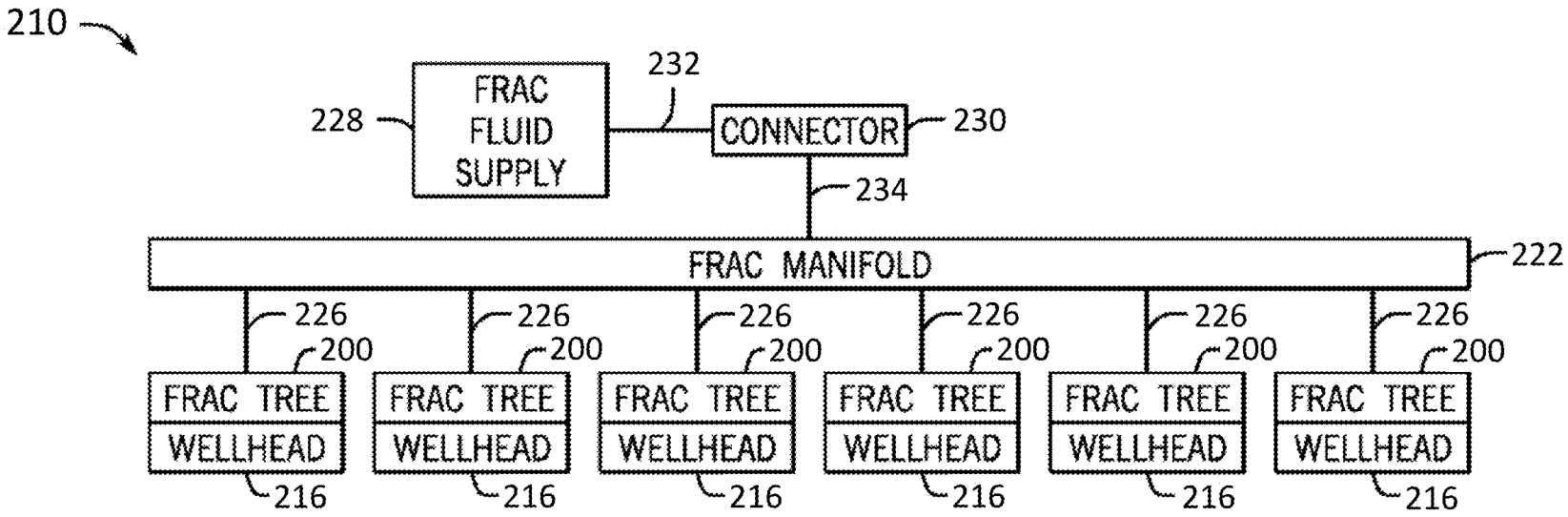
Fig. 5 (Prior Art)
FIG. 5 is a plan view of a prior art adjustable fracing system with a fracturing manifold connected to six fracturing wellheads.

FIG. 5 is a plan view of a prior art adjustable fracing system with a fracturing manifold connected to six fracturing wellheads. Six wellheads 216 have fracing trees 200 installed on top of them and then a single large bore line 226 from each fracing tree 200 is connected to a fracing manifold 222. From this a line 234 is connected through a connector 230 to another main line 234 that goes to the fracing fluid supply 228 which is supplied by the pumping grid 1111 (FIG. 1)

Figure 6:
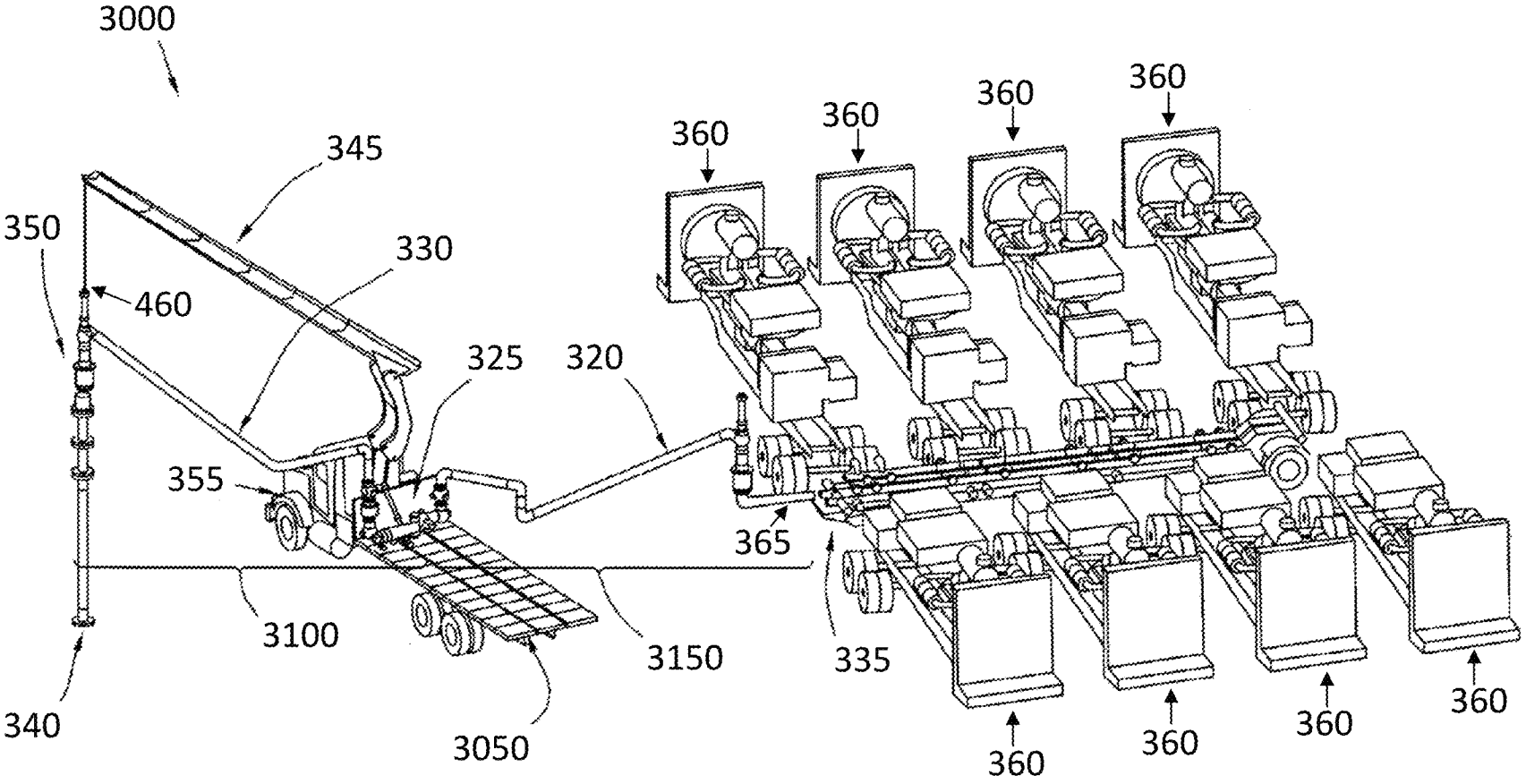
Fig. 6 (Prior Art)
FIG. 6 illustrates a schematic perspective view of one prior art example plug and pump system.

FIG. 6 illustrates a schematic perspective view of one prior art example plug and pump system 3000, in accordance with certain embodiments of the present disclosure. The system 3000 may comprise a platform 3050 on which the well interface 3100 and the manifold interface 3150 may be mounted. Fluid may flow between a docking station 335 and a wellhead 340 through: the manifold interface 3150, including one or more docking station lines 320; the well interface 3100, including one or more wellhead lines 330; and the interface equipment 325 between the manifold interface 315 and the well interface 3100. Accordingly, the manifold interface 315, the interface equipment 325, and the well interface 3100 are configured to be in fluid communication with each other, the docking station 335, and the wellhead 340. Pumping units 360 pump into the main fracing fluid supply line 365.

To minimize the number of connections, the manifold interface 3150 may comprise a single docking station line 320 capable of accessing one or more wellheads from a single platform position, and the well interface 3100 may comprise a single wellhead line 330. The single lines may be capable of delivering fluid at similar rates and pressures that would have previously required multiple lines.

The well interface 3100 and the manifold interface 3150 may each include any components of a surface pipe string, including straight discharge joints, connections, couplings, elbows, swivel joints, valves, plugs, detectors and measurement equipment, etc.

A crane 345 may be mounted on the platform 3050 or on the vehicle chassis near the platform 3050. The crane 345 provide lifting, positioning, or support of components of the plug and pump system 3000 during rig-up/down. The crane 345 also may be utilized to provide additional stability during pumping operations. The crane 345 may be similar in many respects to conventional industrial cranes. The platform 3050 may be fixed, or it may be mounted on a mobile vehicle 355, such as a truck as illustrated in FIG. 7.

As shown in FIG. 6, the well interface 3100 and the manifold interface 3150 are shown in extended positions. FIG. 7, by contrast, shows a schematic perspective view of example plug and pump system 3000 with piping in a retracted position, in accordance with certain embodiments of the present disclosure.

In some embodiments, one or more quick connectors 350 may be utilized to connect the plug and pump system 3000 to the docking station 335 or the wellhead 340. The quick connectors 350 may be locally or remotely operated. In many respects, quick connectors 350 may be similar to conventional quick connects. For example, a quick connector 350 may be of a large, conical shape to allow for a tolerance of several inches when positioning the quick connector 350 above the wellhead 340 (FIG. 6) with the crane 345.

Figure 7:
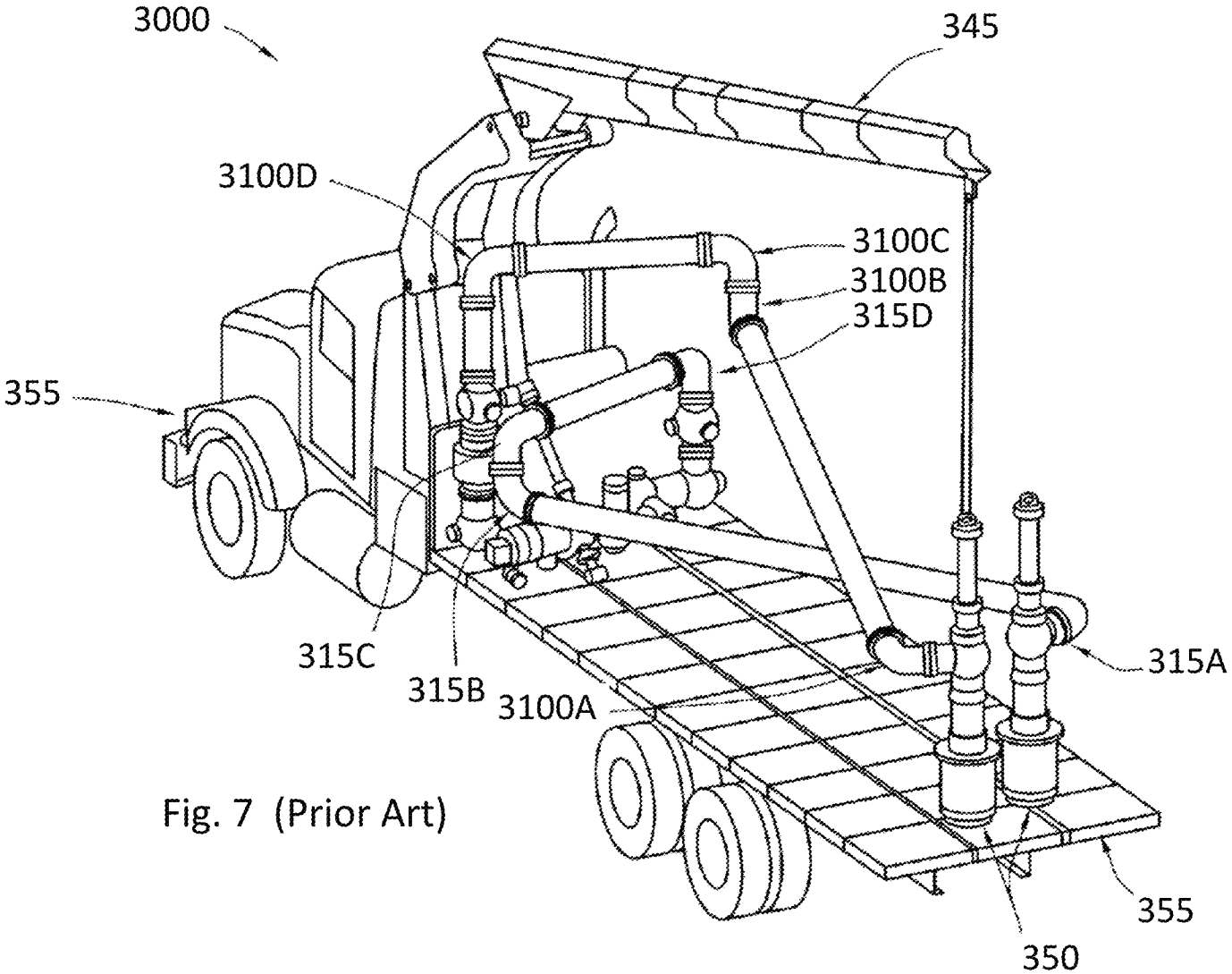
Fig. 7 (Prior Art)
FIG. 7 illustrates a schematic perspective view of one prior art example plug and pump system with the piping in a retracted position.

For the following FIG. 8 to FIG. 14, the numbering from FIGS. 6 and 7 is used for illustration of like parts. In FIGS. 8*a*, 8*b*, 8*c*, 9 and 10 all show eight pumping units 360 pumping fluid into a main fracking fluid supply line 365.

Figure 8C:
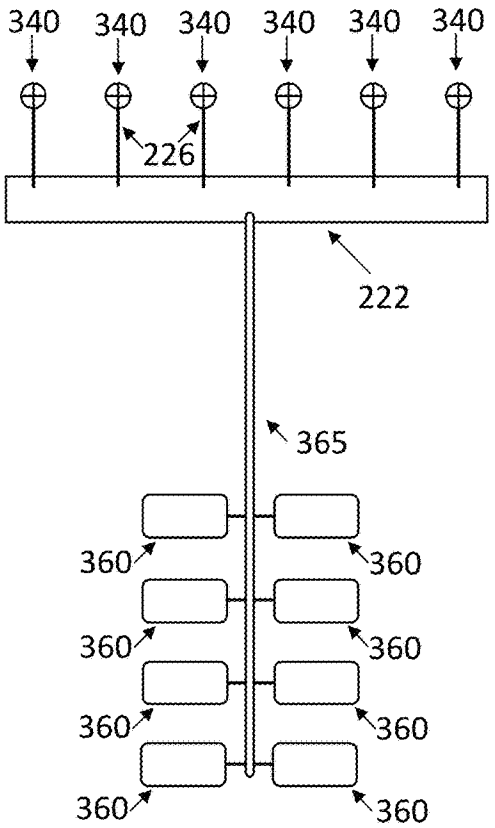
Fig. 8c (Prior Art)
FIG. 8*c* is a schematic plan view of a prior art adjustable fracing system in use with six wells.
Figure 8B:
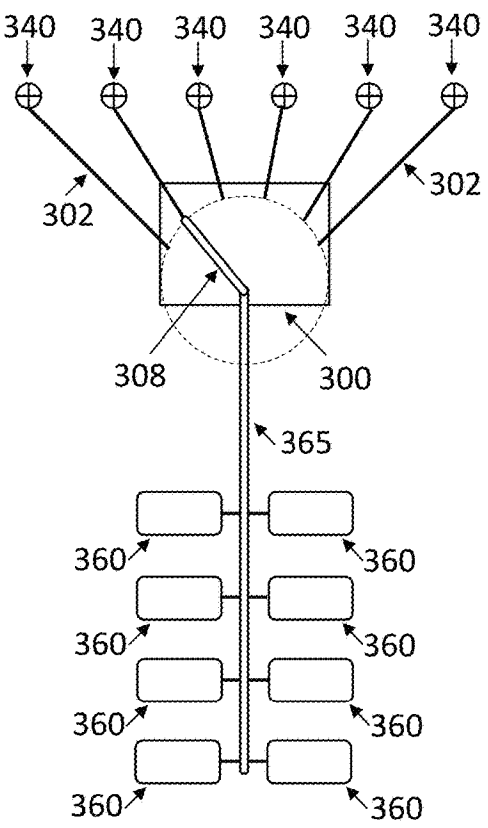
Fig. 8b (Prior Art)
FIG. 8*b* is a schematic plan view of a prior art jumper manifold in use with six wells.
Figure 8A:
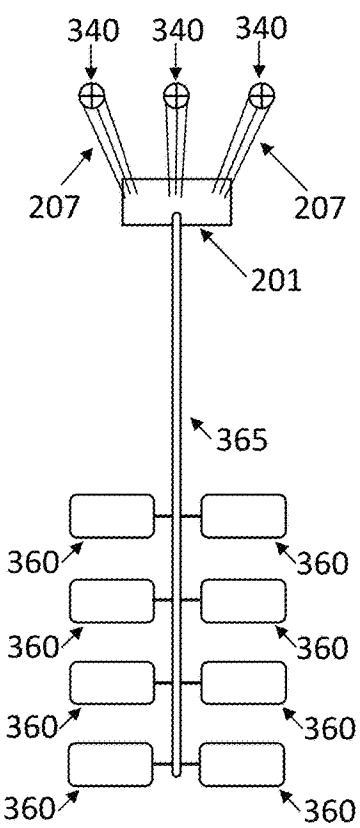
Fig. 8a (Prior Art)
FIG. 8*a* is a schematic plan view of a prior art zipper manifold in use with three wells.

FIG. 8*a* is a schematic plan view of a prior art zipper manifold 201 (FIG. 2) in use with three wells 340. In this common older configuration multiple lines 207 connect the zipper manifold to the individual wellheads 340. If more wells need to be fraced on the same pad, additional zipper manifolds are installed. The drawbacks of such zipper manifolds have been pointed out earlier.

FIG. 8*b* is a schematic plan view of a prior art jumper manifold 300 in use with six wells 340, the main fracing line 365 is routed via a jumper 308 to each well in turn through individual lines, usually single large bore 302 to each well in turn.

FIG. 8*c* is a schematic plan view of a prior art adjustable fracing system in use with six wells 340, the main fracing line 365 goes to a fracing manifold 222 with valves (not shown) that in turn route fracing fluid to each well in turn through lines 226. Essentially this is a combination of two zipper manifolds as illustrated in FIG. 8*a*.

Each one of these rig-ups has its advantages and disadvantages and are used based on customers preferences.

Figure 9:
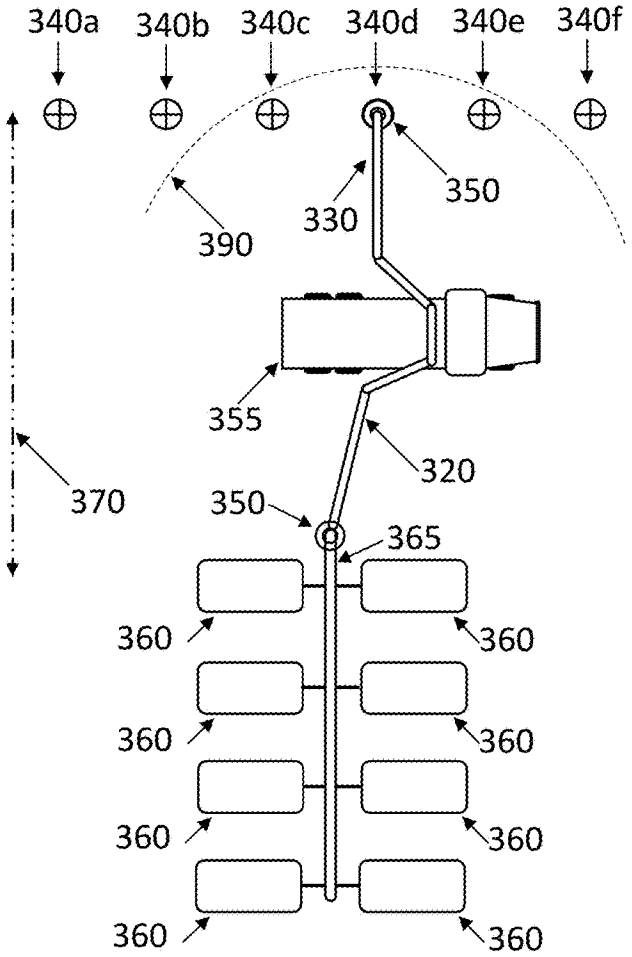
Fig. 9 (Prior Art)
FIG. 9 is a schematic plan view of the prior art plug and pump system rigged up for six wells but only able to reach three wells.

The prior art plug and pump system of FIGS. 6 and 7, is also a system that is preferred by some customers but it has a drawback. FIG. 9 shows such a system rigged up rigged up for six wells but only able to reach three wells. There is a safety requirement that mandates a certain distance 370 from the wellheads 340 to the pumping units 360. The vehicle 355 is usually stationed in the middle between the wellheads 340 and the pumping units 360, connecting the docking station line 320 through a connector 350 to the main fracing fluid line 365. The wellhead line 330 connects to the wellhead with another connector 350. As these lines 320 and 330 are fixed to pivot points on the platform 3050 they have a limited radius of connection. On the wellhead side this is described by arc 390 which is the maximum range over which the wellhead line 330 can reach with the connector 350 at its end. These vehicles 355 having been designed in the era of maximum three wells per pad therefore are usually able to only connect to three wells, in this case wells 340*c*, 340*d* and 340*e*. This causes problems as once the fracing procedure starts, each one of the six wells 340*a* to 340*f* is pumped into in turn which is not possible without moving the truck or adding a second truck.

Figure 10:
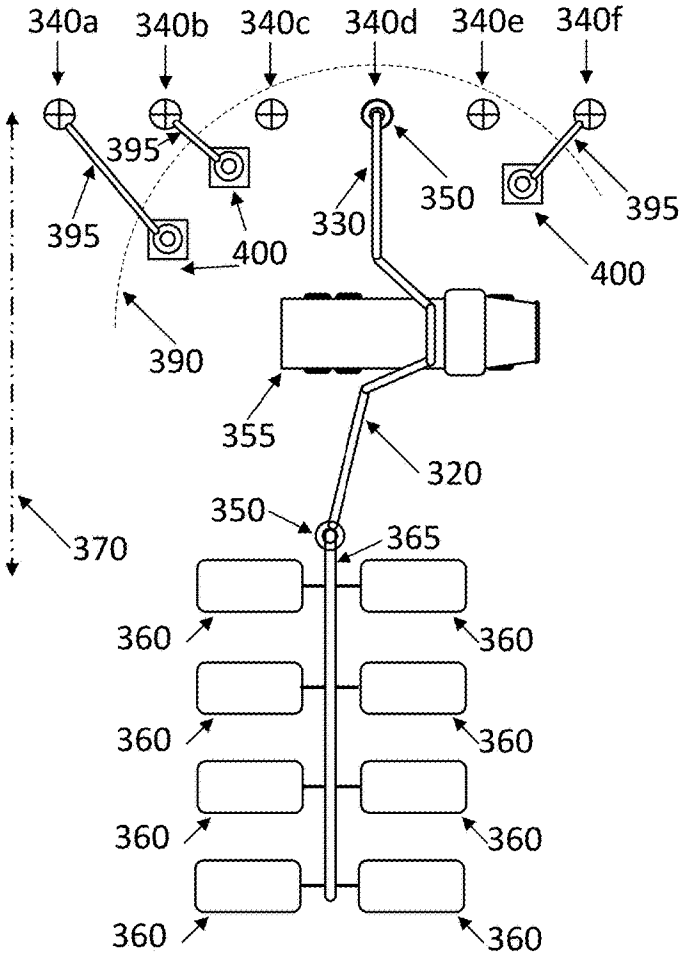
FIG. 10 is a schematic plan view of the prior art plug and pump system rigged up for six wells and with the aid of the current invention able to service all six wells.

Resolving this inefficiency is the object of this invention. Referring now to FIG. 10, there is illustrated an extension of the further wellheads, situated outside of radius 390, by adding to the rig-up a new type of manifold 400 called Modular Fracing Wellhead Extension (MFWE) in accordance with one embodiment. These MFWE are not just simple extensions of line, but rather designed for connection purposes so that the same connection system of lines 320, 330 and connectors from the vehicle 355 can be used.

Such a schematic plan view of the prior art plug and pump system rigged up for six wells and with the aid of the current invention able to service all six wells is shown in FIG. 10. The vehicle 355 is shown in exactly the same position as for FIG. 9. MFWEs 400 are added to the ends of extension lines 395 for wells 340*a*, 340*b* and 340*f*. These MFWEs 400 are placed within the radius of operation 390 of the wellhead line 330 thus enabling the system to be used efficiently and cost effectively without adding a second vehicle 355 or moving same. Having to move the vehicle 355 during the fracing operation is a major issue. The MFWEs are designed with valving and instrumentation ports so that they act as safe extensions of the pressurized wellheads with the same type of connectors as are on the wellheads within the normal range of the wellhead line 330 and connector 350.

Figure 11:
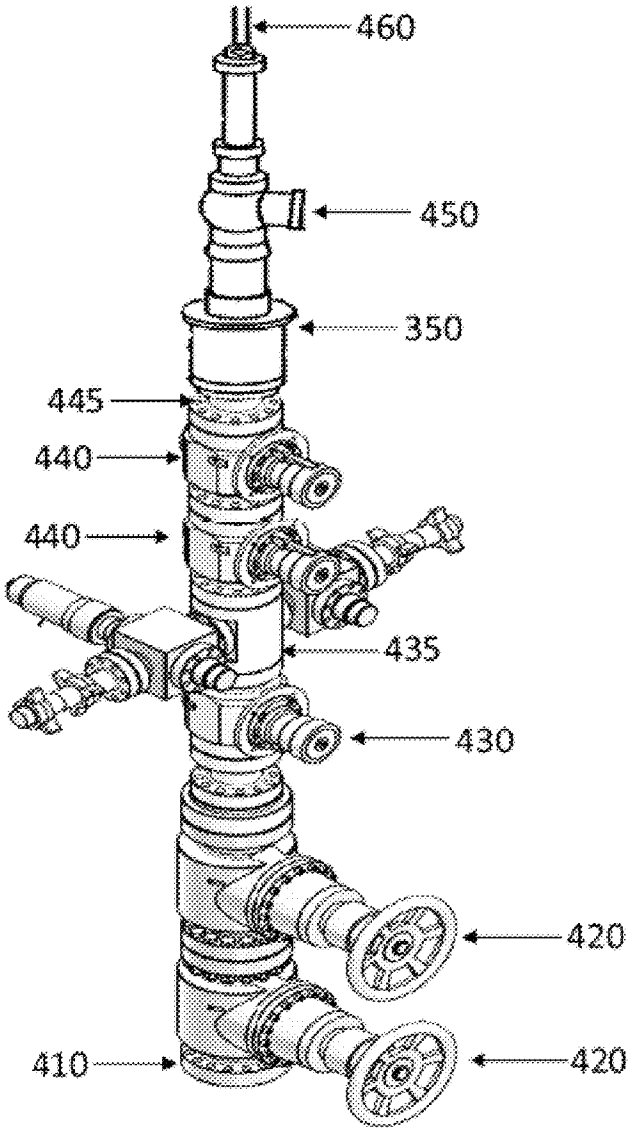
Fig. 11 (Prior Art)
FIG. 11 is an isometric view of a prior art typical fracing wellhead with a connector from the plug and pump system of FIG. 6 installed.

FIG. 11 is an isometric view of a prior art typical fracing wellhead 340 with a connector 350 from the plug and pump system of FIG. 6 installed. It is representative of the typical type of fracing wellhead 340 shown in the preceding figures. From the bottom up the key items are described: a bottom flange 410 that connects to the main wellhead 340 (not shown) being fraced. Valves 420 are master valves that are usually part of the main wellhead 340, typically two gate valves. The sections above that are the main part of the fracing stack with isolation plug valve 430 with a hydraulic actuator then a flow cross 435 and two further hydraulically actuated plug isolation valves 440. At the top is a spool 445 that flanges at the bottom to the frachead at upper valve 440 and has a profile for the connector 350 to latch on. The connector 350 has a side outlet 450 that is connected to the wellhead line 330 (FIG. 6.) and 460 represents the slings going to the crane 345 (FIG. 6). This configuration would be representative of the wellhead 340*d* shown in FIGS. 9 and 10 with the connector 350 being capable of latching onto the fracing stacks on wellheads 340*c* and 340*e* in a similar manner as shown in FIG. 11.

Figure 13:
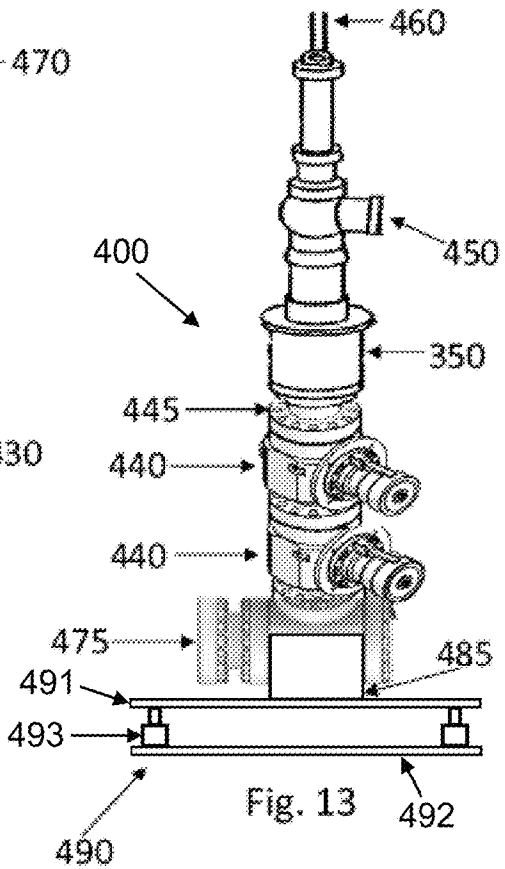
FIG. 13 is showing an embodiment of the invention with a connector from the plug and pump system of FIG. 6 installed.
Figure 12:
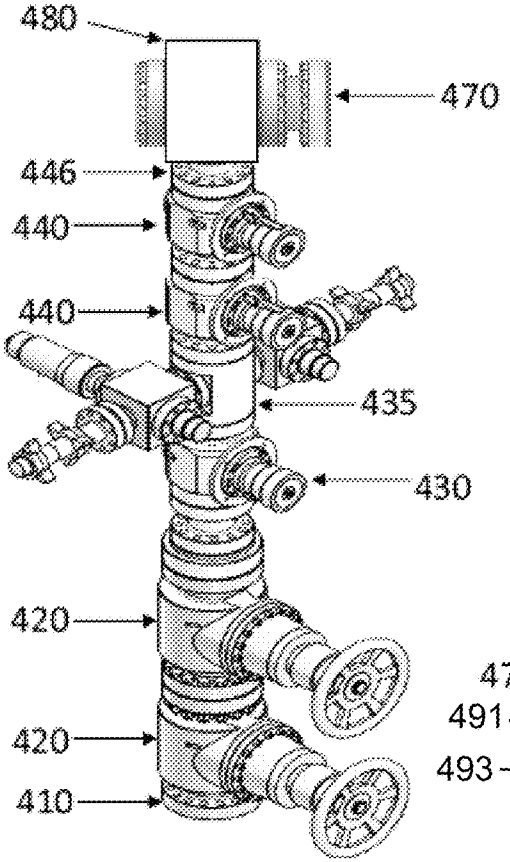
FIG. 12 is an isometric view of a fracing wellhead with a side outlet installed at the top instead of a connector.

Referring now to FIGS. 12 and 13, to enable the connection of the MFWEs 400 to the wellheads 340*a*, 340*b* and 340*f*, they are modified as shown in FIG. 12. The bottom of the wellhead/fracstack can be the same as shown in FIG. 11, but the adapter 446 on top of the uppermost isolation valve 440 is a flanged spool that bolts onto a block tee 480, which could also be an elbow, with a side outlet 470. This side inlet 470 connects to a line 395 (FIG. 10) that leads to the MFWE 400, which is shown in FIG. 13. This can be the configuration for wellheads 340*a*, 340*b* and 340*f* as shown in FIG. 10.

Continuing with FIG. 13, the line 395 (FIG. 10) connects through to outlet 475 of the block tee 485, which could also be an elbow, at the very bottom of the MFWE 400, which is attached to a skid 490. In some embodiments, the block tee 485 has only two external openings, and the two external openings can be oriented at right angle to one another. This configuration can have the advantage of reducing the size of the block tee 485. This configuration can have the advantage of reducing leaks from the block tee 485. To the top of the block 485 a configuration of two isolation valves 440 with a spool and connector 350 that exactly replicates the top of the wellhead shown in FIG. 11. In some embodiments, each isolation valve 440 can have a top inlet and a bottom outlet. This configuration can have the advantage of improving flow through the isolation valves 440 (i.e., when open). The MFWEs 400 in FIG. 10 are placed closer to the vehicle 355 by extension from lines 395 to ensure that they fall within the radius of reach 390 of the articulated vehicle or platform 355. In this manner the access by fracing fluids in turn to each well 340*a* to 340*f* is enabled allowing a cost effective and efficient fracing procedure without moving the vehicle 355 during the fracing operations.

Figure 15:
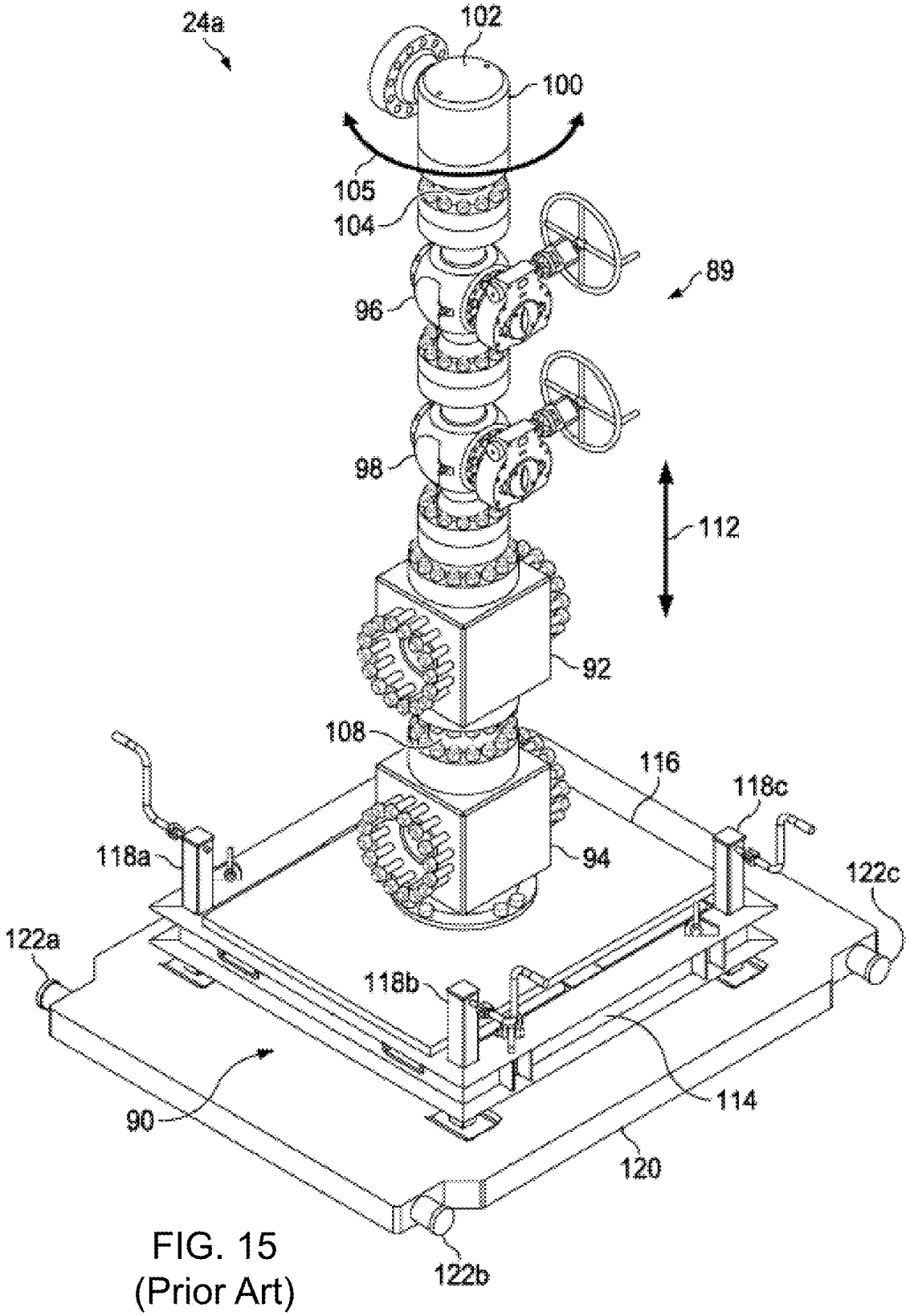
FIG. 15 (Prior Art)
FIG. 15 is a prior art zipper module reproduced from FIG. 7 of U.S. Patent Application Publication No. US2017/0370172 published Dec. 28, 2017, which is incorporated by reference herein.

Some embodiments, the MFWEs 400 can be adjustable in a similar fashion as disclosed in FIG. 7 of U.S. Patent Application Publication No. US2017/0370172 published Dec. 28, 2017, which is incorporated by reference herein in its entirety. FIG. 7 of US2017/0370172 is reproduced as FIG. 15 herein. FIG. 7 is described in paragraphs [0053]-[0054] of US2017/0370172 as follows: "[0053] Turning back to FIG. 7, with continuing reference to FIG. 9, the adjustable skid 90 is configured to displace the zipper tree 89 to align the upper and lower blocks 92 and 94 of the zipper module 24a with corresponding upper and lower blocks of the zipper module 24b (which are analogous to the upper and lower blocks 92 and 94 of the zipper module 24a), as will be discussed in further detail below. More particularly, the adjustable skid 90 is configured to displace the zipper tree 89 up and down in the vertical direction as indicated by FIG. 7's linear arrow 112. The adjustable skid 90 includes a generally rectangular base 114, a carriage plate 116 supported on the base 114, and jacks 118a-d connected to the base 114 (the jack 118d is not visible in FIG. 7). In some embodiments, one or more mounting brackets (not shown) connect the lower block 94 of the zipper tree 89 to the carriage plate 116 of the adjustable skid 90. [0054] The zipper module 24a is positioned on a transport skid 120 that includes lifting pegs 122a-d (the lifting peg 122d is not visible in FIG. 7) configured to facilitate placement of zipper module 24a on a generally horizontal surface proximate one of the frac trees 34a-c via a lifting mechanism, such as, for example, a crane, a forklift, a front-end loader, or another lifting mechanism. The jacks 118a-d are connected to respective corners of the base 114 so that, when the adjustable skid 90 is positioned on the generally horizontal surface proximate the frac tree 34a, the jacks 118a-d are operable to level, and to adjust the height of, the base 114." In some embodiments of the MFWE 400, the skid 490 can be attached to the outlet block 485 or other component of the MFWE 400 for supporting the MFWE on a ground surface. In some embodiments, the skid 490 can include a skid frame 491 attached to the outlet block 485, a skid plate 492 disposed below the skid frame and one or more adjustment mechanisms 493 (e.g., jacks) attached between the skid plate and the skid frame. By operating the one or more adjustment mechanisms, the height of the outlet 475 or of the connector 350 and/or the angle of inclination of the MFWE 400 can be adjusted even if the ground surface is inclined. This enables such MFWEs 400 to be used to create an easier rig-up by allowing the perfect horizontal and vertical alignment for the connector 350 irrespective of any misalignment of the wellheads 340. It should be noted that the current invention is significantly different from this quoted prior art of US2017/0370172 in that the MFWEs 400 receive fracturing fluid flow in from the top through connector 350 as shown in FIG. 13 and flow out from the MFWE is through the outlet 475 at the bottom. The purpose of each MFWE 400 is to provide a level and vertically aligned interface for the connector 350 being articulated from the platform 355. The adjustment mechanism 493 may be hydraulic jacks or threaded screw displacement mechanisms that allow precise alignment.

Figure 14:
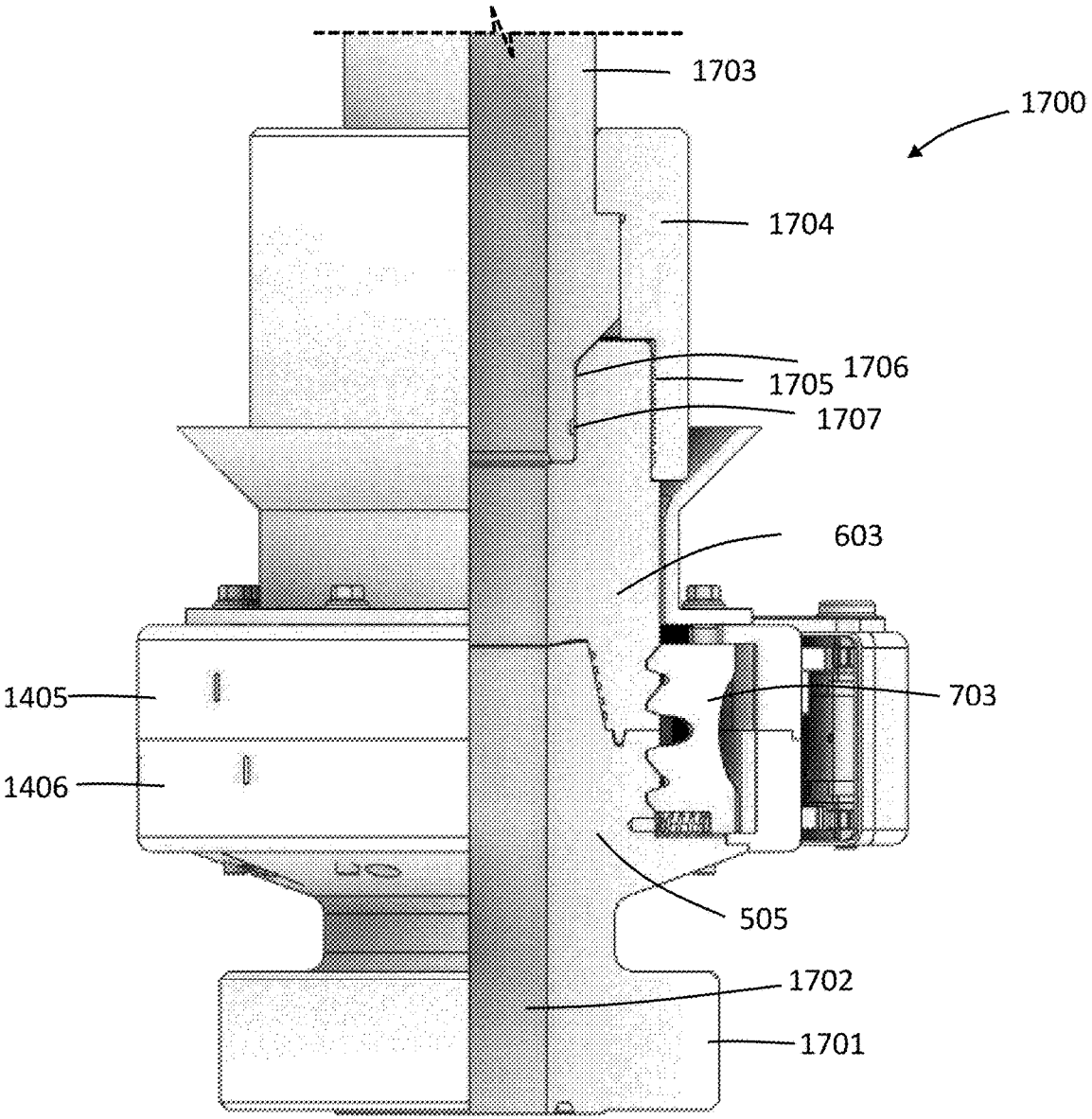
FIG. 14 is side view with a half cross section of an alternative embodiment of the invention using another type of connector.

FIG. 14 shows an alternative embodiment of the connector assembly 1700, which can be used to act as a high-pressure connector on top of the fracing stack as shown in FIG. 11 instead of connector 350. The connector 1700 can be substantially as disclosed in U.S. patent application Ser. No. 16/696,563, which is incorporated by reference herein in its entirety. The connector 1700 can also be used instead of connector 350 in FIG. 13. The flange 1701 would be bolted to either uppermost valve 440 in FIG. 11 or FIG. 13, allowing flow through bore 1702. The bottom part 505 of the connector assembly 1700 will stay on the fracing head of FIG. 11 or the MFWE of FIG. 13. The upper part 603 is removable when the multiple dogs 703 disengage (only one dog shown in cross-section). The dogs 703 are engaged/disengaged by rotation of rings 1405 and 1406. For the application described here, the upper part of the connector 603 could be integral to a side outlet similar to 450 in FIGS. 11 and 13. Alternatively, the upper part 603 could be manufactured with a flanged or other suitable interface for connecting to a side outlet 450. The alternative connector assembly 1700 is merely to illustrate that several types of connectors can be used for this application, typically being remote operated by hydraulics (not shown).

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed is:

1. A modular wellhead extension manifold for providing a fluid connection from a wellhead line supplying a source of fluid for delivery to a wellhead that is disposed beyond the reach of the wellhead line, to a wellhead extension line connected to the wellhead, the modular wellhead extension manifold comprising:

an outlet block having a top-facing fluid inlet and a side-facing fluid outlet operably connectable to a wellhead extension line that is connected to a wellhead for delivering a fluid to the wellhead;

a first hydraulically actuated isolation valve having a bottom-facing fluid outlet operably connected to the fluid inlet of the outlet block, a top-facing fluid inlet, and a first valve mechanism connected between the fluid outlet and fluid inlet of the first isolation valve;

a second hydraulically actuated isolation valve having a bottom-facing fluid outlet operably connected to the fluid inlet of the first isolation valve, a top-facing fluid inlet, and a second valve mechanism connected between the fluid outlet and fluid inlet of the second isolation valve;

wherein each respective valve mechanism of the respective isolation valve is selectively hydraulically movable between an open position allowing fluid flow through the respective isolation valve and a closed position blocking fluid flow through the respective isolation valve;

a connector assembly having a lower portion including a bottom-facing fluid outlet operably connected to the fluid inlet of the second isolation valve and an upper portion including a fluid inlet connectable to a wellhead line for receiving the fluid from the wellhead line;

wherein the upper and lower portions of the connector assembly can be selectively engaged to, and disengaged from, one another without use of bolted fasteners;

wherein, when engaged to one another, the upper and lower portions of the connector assembly form a fluid-tight path from the fluid inlet of the connector to the fluid outlet of the connector and the upper and lower portions cannot be moved apart from one another; and wherein, when disengaged from one another, the upper and lower portions of the connector assembly can be repositioned apart from one another; and wherein, when the upper and lower portions of the connector assembly are engaged to one another and the respective valve mechanisms of the first and second isolation valves are in the open positions, the fluid from the wellhead line can flow through the modular wellhead extension manifold into the wellhead extension line for delivery to the wellhead.

2. The modular wellhead extension manifold of claim 1, wherein selective operation of the respective hydraulically actuated isolation valves is remotely controllable from a predetermined distance away from the modular wellhead extension manifold.

3. The modular wellhead extension manifold of claim 1, wherein the upper portion of the connector assembly has a side facing fluid inlet that can rotate relative to the lower portion of the connector assembly to change an angle of the side-facing fluid inlet of the connector relative to the side-facing fluid outlet of the outlet block.

4. The modular wellhead extension manifold of claim 1, wherein the lower portion of the connector assembly further comprises a spool, wherein the spool comprises:

a flanged bottom end for bolted connection to the fluid inlet of the second isolation valve; and a top configured with a profile for the upper portion of the connection assembly to latch on.

5. The modular wellhead extension manifold of claim 4, wherein a height of the fluid inlet of the connector above the outlet block can be selected by changing a length between the flanged bottom end of the spool and the profile of the spool.

6. The modular wellhead extension manifold of claim 1, wherein the connector assembly further comprises:

a plurality of dogs arrayed annularly around a junction between the upper and lower portions of the connector assembly, each dog having a plurality of inward-facing teeth;

wherein the lower portion of the connector assembly includes a grooved upper end adjacent the junction and a flanged bottom end for bolted connection to the fluid inlet of the second isolation valve;

wherein the upper portion of the connector assembly includes a grooved lower end adjacent the junction and an interface for the fluid inlet; and at least one ring encircling the upper and lower portions and operably connected to the plurality of dogs, and wherein rotation of the ring in a first direction relative to upper and lower portions causes the plurality of dogs to move inwards until the teeth engage the grooves on the upper and lower portions to engage the upper and lower portions; and wherein rotation of the ring in a second direction relative to the upper and lower portions causes the plurality of dogs to move outward until the teeth disengage the grooves on the upper and lower portions to disengage the upper and lower portions.

7. The modular wellhead extension manifold of claim 6, wherein one of the upper and lower portions defines an axial socket, and the other of the upper and lower portions defines a projection configured to interfit with the axial socket to maintain axial alignment of the upper and lower portions when engaged.

8. The modular wellhead extension manifold of claim 1, further comprising:

a skid having a skid frame operably connected to the outlet block; and wherein the skid supports the modular wellhead extension manifold on a ground surface.

9. The modular wellhead extension manifold of claim 8, wherein the skid frame further comprises:

a skid base plate disposed below the skid frame; and a plurality of jacks attached between the skid frame and the skid base plate to allow changing a height of the outlet block relative to the ground surface by selectively changing lengths of the plurality of jacks.

10. The modular wellhead extension manifold of claim 8, wherein the skid frame further comprises:

a skid base plate disposed below the skid frame; and a plurality of jacks attached between the skid frame and the skid base plate to allow changing an angle of the outlet block relative to the ground surface by selectively changing lengths of the plurality of jacks.

11. The modular wellhead extension manifold of claim 1 whereby the manifold is adjustable in a vertical axis, horizontal axis and angular axis, thereby enabling easier connection.

* * * * *